US005560479A

United States Patent [19]

Leyba et al.

[11] Patent Number: 5,560,479

[45] Date of Patent: Oct. 1, 1996

[54] GOLF BAG WITH REMOVABLE PANELS AND METHOD FOR AFFIXING INDICIA THERETO

[75] Inventors: Frank L. Leyba, Long Beach; Ralph V. Quarantello, Orange, both of Calif.

[73] Assignee: Quality Sports, Inc., Placentia, Calif.

[21] Appl. No.: 187,623

[22] Filed: Jan. 25, 1994

[51] Int. Cl.[6] ..... A63B 55/02

[52] U.S. Cl. ..... 206/315.5; 206/315.3

[58] Field of Search ..... 206/315.5, 315.4, 206/315.3; 190/110, 111; 150/113

[56] References Cited

U.S. PATENT DOCUMENTS

| | | | |
|---|---|---|---|
| 3,061,057 | 10/1962 | Miller | 190/110 |
| 4,249,586 | 2/1981 | Setani | 206/315.5 X |
| 4,350,194 | 9/1982 | Brown | 206/315.5 |
| 4,729,460 | 3/1988 | Kim | 190/111 |
| 4,779,725 | 10/1988 | Gerber | 206/315.3 |
| 5,022,528 | 6/1991 | Savoy | 150/113 |
| 5,042,704 | 8/1991 | Izzo | 206/315.5 X |
| 5,176,253 | 1/1993 | Perrin et al. | 206/315.5 |
| 5,186,290 | 2/1993 | Takayama | 190/110 X |
| 5,209,279 | 5/1993 | Wilson | 190/110 X |
| 5,222,598 | 6/1993 | Yamazoe | 206/315.5 |
| 5,265,719 | 11/1993 | Wand | 190/111 |

*Primary Examiner*—Allan N. Shoap
*Assistant Examiner*—Christopher J. McDonald
*Attorney, Agent, or Firm*—Blakely, Sokoloff, Taylor & Zafman

[57] ABSTRACT

A golf bag for storing and transporting a set of golf clubs including customized indicia affixed to the golf bag and a method for affixing such indicia. The golf bag comprising a flat, single-walled panel which is completely removable from the golf bag in order to facilitate affixing indicia onto the panel.

13 Claims, 2 Drawing Sheets

GOLF BAG WITH REMOVABLE PANELS AND METHOD FOR AFFIXING INDICIA THERETO

BACKGROUND OF THE INVENTION

1. Field of the Invention

The present invention relates to a golf bag. More specifically, the present invention relates to a golf bag having a removable panel to facilitate affixation of insignias and other indicia onto the golf bag as well as a method for affixing such indicia.

2. Description of Related Art

Growing in popularity each year, the game of golf is a sport played throughout the world by persons of all ages and of all skill levels. It is commonly known that a golf bag is used to transport a set of golf clubs, golf balls and other golfing accessories throughout a golf course. As shown in FIG. 1, a conventional golf bag 1 typically consists of an elongated, tubular chamber 2 having a closed end 3 and an open end 4. The set of golf clubs 5 is stored and transported within the conventional golf bag 1 by inserting these clubs through the open end 4 of the chamber 2. A carrying strap 6 is attached to a second longitudinal side 7 of the conventional golf bag 1, allowing a person to carry the conventional golf bag 1 by inserting his or her shoulder between the carrying strap 6 and the second longitudinal side 7.

The conventional golf bag 1 also includes a number of pockets **8*a*–8*n* ("n" being equal to an arbitrary number) which are positioned at preselected locations. For example, the conventional golf bag 1 generally includes at least one large back pocket 8*a* disposed on a first longitudinal side 9, opposite the second longitudinal side 7, for storing large accessories and clothing therein and a small rear pocket 8*n* disposed on the second longitudinal side 7 for holding golf balls, tees, golf ball markers and other smaller accessories. The back 8*a* pocket, accessable by unlacing a zipper 10 laterally positioned along the first longitudinal side 9, has always been non-detachable while the rear pocket 8*n*** is generally non-detachable, but may be constructed as a detachable dual-walled, fully-enclosed pouch as illustrated in U.S. Pat. No. 5,176,253 to Perrin et al.

As the sport of golf becomes more and more popular, it is becoming more difficult for a golfer to identify his or her golfing bag. As a result, for identification purposes, golfers are beginning to attach tags, stickers, and other identification items onto the carrying strap and/or the golf bag itself in order to enable the golfer to quickly distinguish his or her golf bag from another. However, over time and after being exposed to moisture, wind and other elements, these identification items are unreliable since they have a tendency of separating from the golf bag 1. Besides the non-aesthetic appeal of the above identification items, the tags and stickers, in particular, have sharp edges exposing the golfer to occasional cuts when he or she is carrying the golf bag.

Since tags, stickers and the like are unreliable and potentially harmful, many golfers have turned to sewing and/or embroidering indicia such as monograms, mottos, patches and the like onto their golf bags for distinguishing their golf bags as well as for individual expression. It is fashionable to have golf bags which display a decal from a famous golf course visited by the golfer, a golf facility which sold the bag or other distinctive ornamentations. Unfortunately, sewing and/or embroidering indicia onto the conventional, bulky golf bags is extremely difficult and labor intensive since it is accomplished solely by hand, without any assistance by machines.

Moreover, even the detachable pouch disclosed in Perrin et al., which eliminates the bulkiness problem, does not facilitate the attachment of indicia for two reasons. First, although it would be less difficult to sew and/or embroider indicia onto the pouch than an entire golf bag, its dual-walled design is not conducive to sewing and/or embroidery, especially for intricate designs. Second, embroidery on the pouch attached below the carrying strap does not provide optimal visibility for identification or for aesthetic expression purposes.

SUMMARY OF THE INVENTION

In light of the foregoing, it can be appreciated that there exists a need for a golf bag which greatly simplifies the affixation of indicia for identification and expression purposes. Accordingly, it would be a great advantage and therefore an object of the present invention to provide a golf bag having a single-walled removable golf panel.

It is also an object of the present invention to provide a golf bag having a panel removably coupled by a securing mechanism placed around the periphery of the panel.

It is another object of the present invention to provide a golf bag having a panel removably coupled to the golf bag by any securing mechanism including, but not limited to, clasps, Velcro, snaps and the like.

It is yet another object of the present invention to provide a method to facilitate the affixation of insignias, decals and other indicia onto any portion of the removable panel.

These and other objects of the present invention are accomplished by providing a golf bag having a panel which can be easily removed from the golf bag. The panel is disposed on a longitudinal side of the golf bag by a securing mechanism such as, for example, a zipper, snaps, Velcro fastening members and the like positioned around the periphery of the panel. The panel forms a storage compartment between an inner suface of the panel and the golf bag when the panel is still partially secured to the golf bag. However, when completely unsecured, the panel can be removed for affixation of indicia by machine or hand, if desired.

BRIEF DESCRIPTION OF THE DRAWINGS

The objects, features and advantages of the present invention will become apparent from the following description of the present invention in which.

DETAILED DESCRIPTION OF THE INVENTION

A golf bag is described having a removable panel for facilitating attachment or affixation of indicia onto the panel by sewing, embroidery and the like. In the following detailed description, numerous specific details are set forth, such as the specific elements of the panel and its positioning on the golf bag. It is apparent however, to one skilled in the art, that the present invention may be practiced without incorporating such specific elements or positioning the panel in such a fashion.

Figure 2:
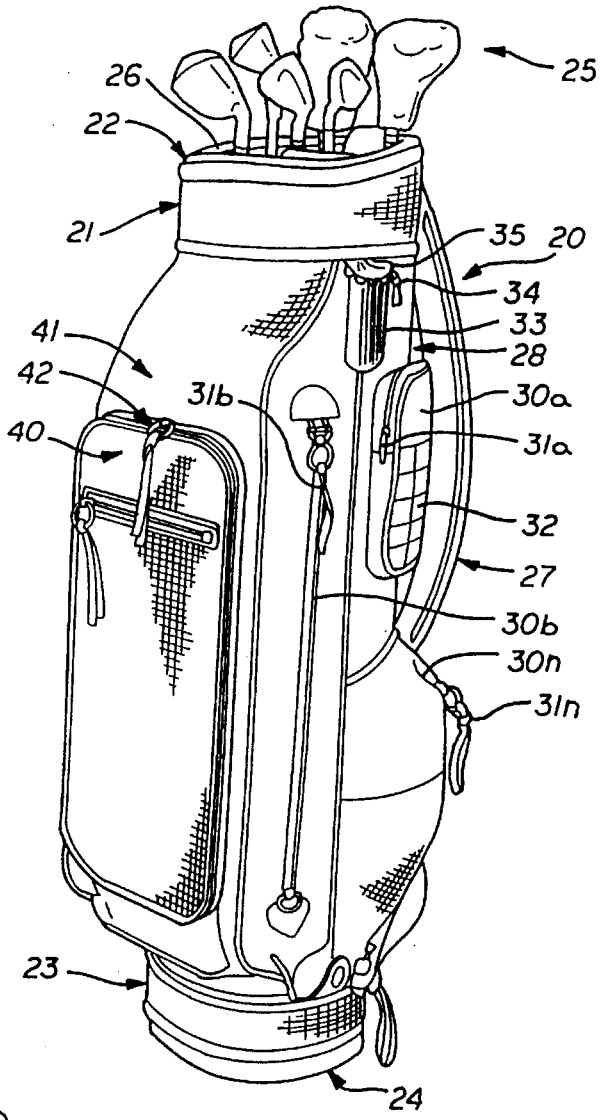
FIG. 2 is a perspective view of one embodiment of the present invention.

Referring to FIG. 2, an embodiment of a golf bag having a removable panel is illustrated. The golf bag 20 has a generally cylindrical storage tube or chamber 21 made of any rigid material including, but not limited to plastic, metal, wood and the like. The storage tube 21 comprises an open first end 22 and a closed second end 23. The second end 23 is closed by a substantially circular, flat base 24 made of any of the above-identified rigid materials. A set of golf clubs 25 is stored and transported by inserting the same through the first end 22 so as to rest on the base 24 within the storage tube 21. A separator 26, being a plurality of lateral panels attached to the first end 22 of the golf bag 20, allowing a golfer to selectively separate his or her golf clubs 25 according to club size, etc. Preferably, the separator 26 includes at least one sheet of water-resistant material (not shown) coupled between the separator 26 and the base 24 for complete separation of the clubs.

A carrying strap 27, preferably padded, is attached to a second longitudinal side 28 of the golf bag 20 by any known fastening mechanisms including buckles, loops and clasps, rivets and the like. In FIG. 2, the carrying strap 27 has a clasp at a top strap end coupling the carrying strap 27 to a loop, which is affixed to the first end 22 of the golf bag 20 by a first flap. In addition, a bottom strap end of the carrying strap 27 has a buckle coupled with its mating buckle being secured by a second flap.

A plurality of pockets 30*a*–30*n* for storage of golfing accessories and personal items are positioned at different predetermined locations throughout the golf bag 20. These pockets are closed and opened by zippers 31*a*–31*n*. It is contemplated, however, that the pockets 30*a*–30*n* may be opened and closed by many other fastening mechanisms such as snaps, Velcro fastening members and the like. At least one of the plurality of pockets 30*a* includes a mesh auxiliary pocket 32 superimposed thereon for easy storage of articles without unlacing and lacing the zipper 31*a* for the pocket 30*a*. Moreover, there exists a cylindrical pre-folded flap 33 in order to store an umbrella (not shown). A fastener 34 is attached to a top periphery 35 of the pre-folded flap 33 to selectively secure or release the umbrella.

Figure 1:
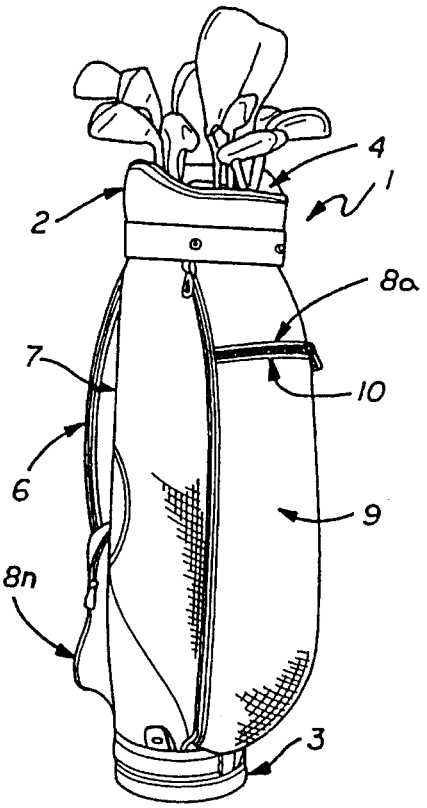
FIG. 1 PRIOR ART
FIG. 1 is a perspective view of a conventional prior art golf bag.

Unlike conventional golf bags which include a non-detachable large back pocket for storage of clothing and other large accessories as shown in FIG. 1, the present invention comprises a removable panel 40 attached to a first longitudinal side 41 by a securing mechanism 42 including, without limitation, a zipper, snaps, Velcro fastening members and any other fastening members having a mating design which are positioned around the periphery of the panel 40. Although the first longitudinal side 41 is shown in FIG. 2 to be opposite the second longitudinal side 28, it is contemplated that the first longitudinal side 41 could be any longitudinal side of the golf bag 20.

Figure 3:
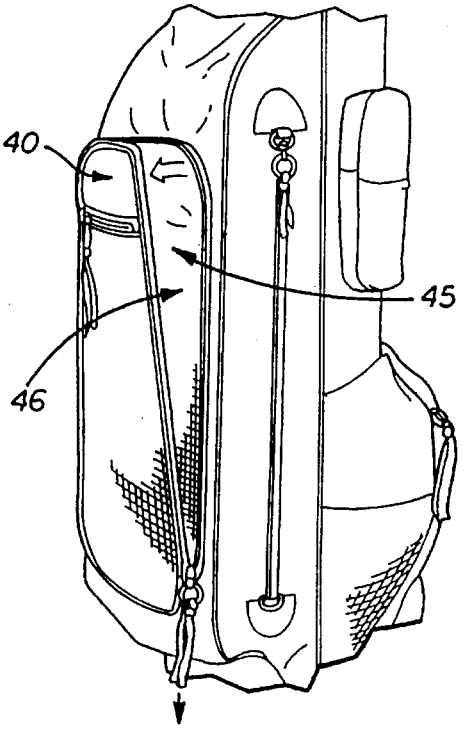
FIG. 3 is a perspective view of the removable panel partially detached from the golf bag.
Figure 5:
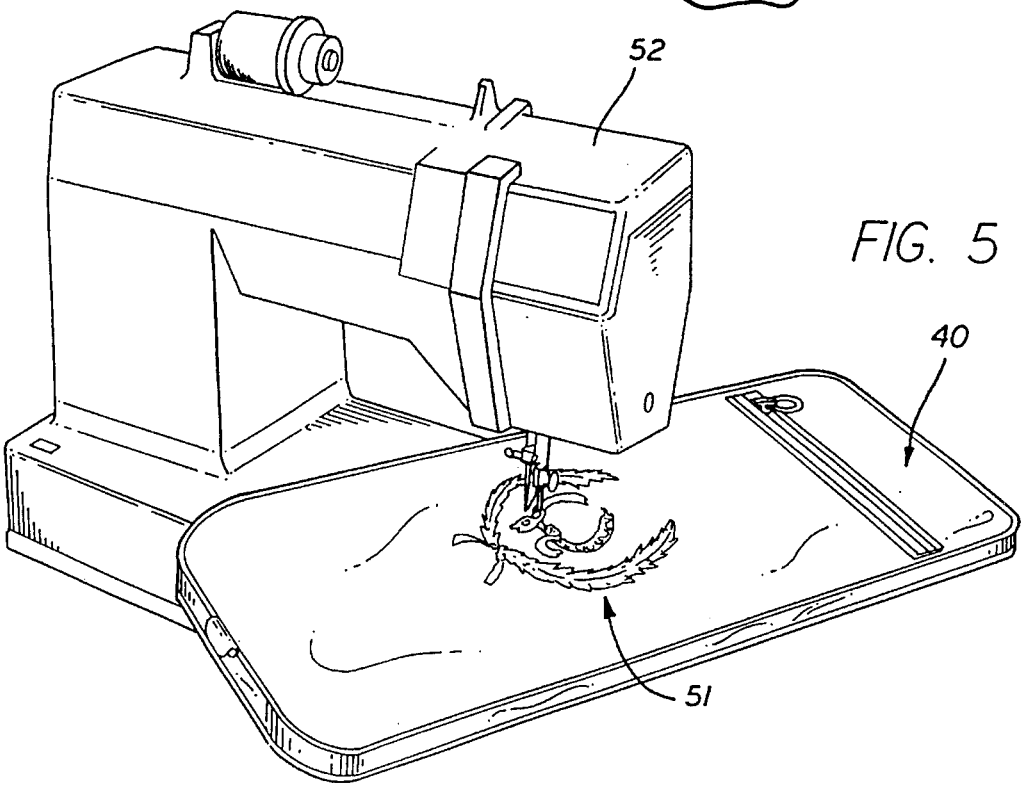
FIG. 5 illustrates the affixation of indicia onto a portion of the removable panel.

As shown in FIG. 3, the panel 40 forms a storage compartment 45 between the panel 40 and a lining material 46 surrounding the storage tube 21, wherein the storage compartment 45 is accessible when the panel 40 is still partially secured to the golf bag 20. When completely unsecured, the panel 40 can be removed for attachment of indicia 51 by a machine 52 as shown in FIG. 5. The panel 40 has a total area greater than one-half the area of the first longitudinal side 41, although the panel 40 could be designed to have any desired dimensions. While it is preferable for the panel 40 to be part of a storage compartment, it could be integral with one of the longitudinal sides of the golf bag 20 where its primary and possibly sole function is to bear customized indicia.

Figure 4:
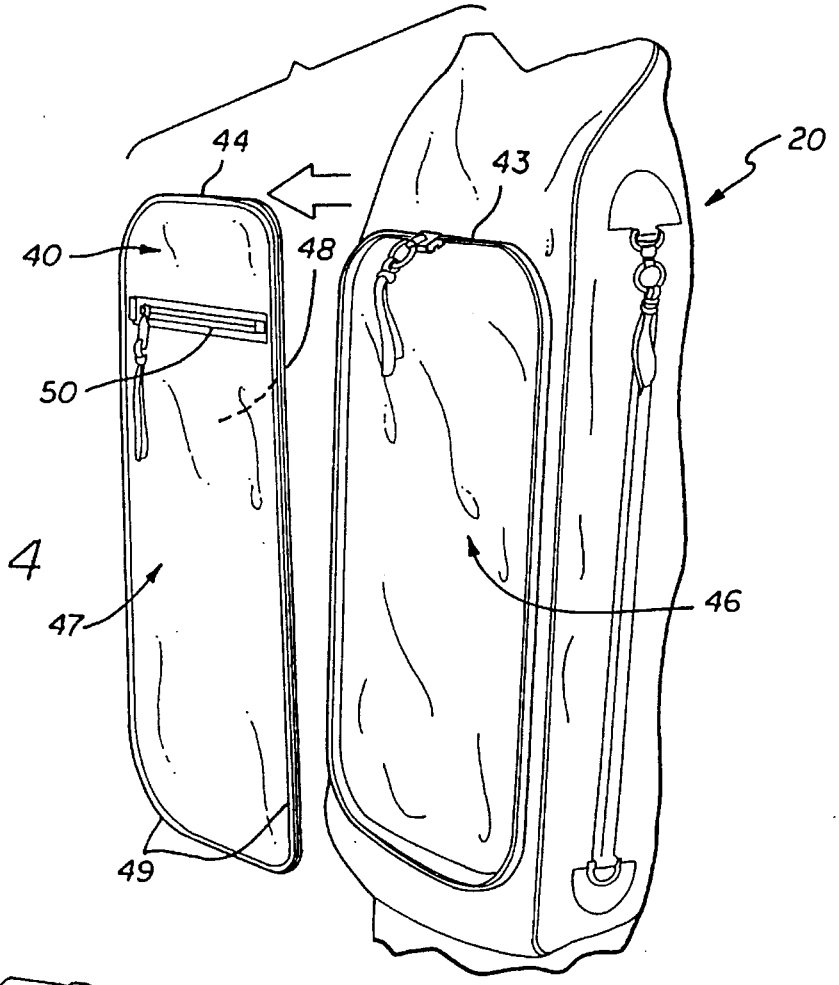
FIG. 4 is an exploded view of the removable panel completely detached from the golf bag.

Referring to FIG. 4, the panel 40 comprises an outer surface 47 made of water-resistant material identical to the lining material 46 of the golf bag 20 (e.g., nylon, synthetic and genuine leather, etc.) and an inner surface 48 being made of a generally padded material. The inner surface 48 is coupled to the outer surface 47 around its periphery 49 to provide limited rigidity and cushioning to the panel 40. Such rigidity and cushioning assists in attaching and detaching to the panel 40.

The panel 40 further comprises the securing mechanism 42 (briefly discussed in reference to FIG. 3) and a pocket 50 cut laterally into the outer surface 47 for storage purposes. The securing mechanism 42 of the panel 40 is positioned around the periphery 49 of the panel 40. The securing mechanism 42 includes a first securing portion 43 attached to the golf bag 20 and a second mating securing portion 44, a mate to the first securing portion 43, being attached to the panel 40 itself. In this embodiment, the first securing portion 43 is a zipper and the second mating securing portion 44 is a mate for the zipper, both of which are aligned for coupling. However, it is contemplated that the second mating securing portion 44 could include a zipper while the first securing portion includes a mate for the zipper and the first and second securing portions 43 and 44 may include a plurality of zippers, any male and female snap combination, Velcro and a Velcro receptor combination or any other mating fastening members which perform the same functions.

As impliedly shown in FIG. 5, indicia can be attached or affixed to the panel 40 in the following manner. The first step is to completely remove the panel 40 from the golf bag 20 by separating the first securing portion 43 from the second securing portion 44. Next, the indicia 51 is attached by sewing, embroidery and the like by hand, or preferably by the machine 52 since the panel 40 is relatively flat by nature having a single-walled structure. After the indicia has been attached to the panel 40, the panel 40 is re-attached to the golf bag 20 by aligning and coupling the first and second securing portions 43 and 44 together.

The present invention described herein may be designed in many different configurations. While the present invention has been described in terms of a specific embodiment, other embodiments may come to mind to those skilled in the art without departing from the spirit and scope of the present invention. The invention should, therefore, be measured in terms of the claims which follow.

What is claimed is:

1. A golf bag comprising:

a storage tube having an open first end and a closed second end for storing and transporting a golf club; and a single-walled substantially planar panel member removably coupled to a first longitudinal side of the golf bag in order to facilitate affixation of indicia to said single-walled panel member, said single-walled panel member having an inner surface and an outer surface, wherein said outer surface is visible when said single-walled panel member is attached to the golf bag.

2. The golf bag according to claim 1, further comprising a carrying strap coupled to the golf bag.

3. The golf bag according to claim 2, wherein carrying strap is coupled to a second longitudinal side of the golf bag diametrically opposite said first longitudinal side.

4. The golf bag according to claim 1, wherein the single-walled panel member is removably coupled to the first longitudinal side by a securing mechanism including a first securing portion coupled to the golf bag and a second mating securing portion which is positioned about a periphery of said single-walled panel member, said second mating securing portion being aligned with and coupled to the first securing portion.

5. The golf bag according to claim 4, wherein the securing mechanism is selected from a group consisting of a zipper, a plurality of snaps, a Velcro fastening member and other fastening means having mating members.

6. The golf bag according to claim 5, wherein said outer surface is made of a water-resistant material and said inner surface is made of a padded material.

7. A golf bag comprising:

a storage tube having an open first end and a closed second end for storing and transporting a golf club;

a material attached to said storage tube forming an exterior surface for the golf bag;

a carrying strap coupled to a second longitudinal side of the golf bag; and a single-walled substantially planar panel member removably coupled to a first longitudinal side of the golf bag diametrically opposite said second longitudinal side so that said single-walled panel member is separately detachable from said first longitudinal side of said golf bag in order to facilitate affixation of indicia to said single-walled panel member, wherein an outer surface of said single walled panel member is made of said material forming said exterior surface of the golf bag so that said outer surface is visible when said panel member is attached to the golf bag.

8. The golf bag according to claim 7, wherein said single-walled panel member further includes:

a second mating securing portion circumscribing a perimeter of said single-walled panel member, said second mating securing portion being aligned with a first securing portion coupled to the first longitudinal side of the golf bag, wherein said second mating securing portion being coupled to said first securing portion in order to fixedly attach said single-walled panel member to the golf bag.

9. The golf according to claim 8, wherein the first securing portion is a first zipper member.

10. The golf according to claim 9, wherein the second mating securing portion includes a second zipper member for mating with said first zipper member.

11. The golf bag according to claim 10, wherein said panel member further includes a pocket having a lateral opening cut through the outer surface.

12. The golf bag according to claim 8, wherein said outer and inner surfaces of said single-walled panel member are made of water-resistant material and a padded material, respectively.

13. A golf bag comprising:

a storage tube having an open first and a closed second end for storing a golf club after said golf club is inserted through the open first end; and a single-walled substantially planar panel member coupled to a first longitudinal side of said golf bag through a securing mechanism including a second mating securing portion around a periphery of said single-walled panel member and a first securing portion being geometrically aligned with said second mating securing portion and coupled to said first longitudinal side of said golf bag, said single-walled panel member is completely detachable from said first longitudinal side of said golf bag by decoupling said second mating securing portion from said first securing portion, wherein said outer surface is visible when said single-walled panel member is attached to the golf bag.

* * * * *

US005560479C1

(12) EX PARTE REEXAMINATION CERTIFICATE (7785th)

United States Patent

Leyba et al.

(10) Number: US 5,560,479 C1
(45) Certificate Issued: Oct. 5, 2010

(54) GOLF BAG WITH REMOVABLE PANELS AND METHODS FOR AFFIXING INDICIA THERETO

(75) Inventors: Frank L. Leyba, Long Beach, CA (US); Ralph V. Quarantello, Orange, CA (US)

(73) Assignee: West Coast Trends, Inc., Huntington Beach, CA (US)

Reexamination Request:
No. 90/009,227, Jul. 24, 2008

Reexamination Certificate for:

| | |
|---|---|
| Patent No.: | **5,560,479** |
| Issued: | **Oct. 1, 1996** |
| Appl. No.: | **08/187,623** |
| Filed: | **Jan. 25, 1994** |

(51) Int. Cl.
*A63B 55/02* (2006.01)

(52) U.S. Cl. ..... 206/315.5; 206/315.3
(58) Field of Classification Search ..... None
See application file for complete search history.

(56) References Cited

U.S. PATENT DOCUMENTS

| | | | | | |
|---|---|---|---|---|---|
| 4,350,194 | A | * | 9/1982 | Brown | 206/315.5 |
| 5,222,598 | A | * | 6/1993 | Yamazoe | 206/315.5 |
| 5,402,883 | A | | 4/1995 | Shin | |

FOREIGN PATENT DOCUMENTS

| | | |
|---|---|---|
| JP | 55-158763 | 11/1980 |

* cited by examiner

*Primary Examiner*—Jeffrey R. Jastrzab

(57) ABSTRACT

A golf bag for storing and transporting a set of golf clubs including customized indicia affixed to the golf bag and a method for affixing such indicia. The golf bag comprising a flat, single-walled panel which is completely removable from the golf bag in order to facilitate affixing indicia onto the panel.

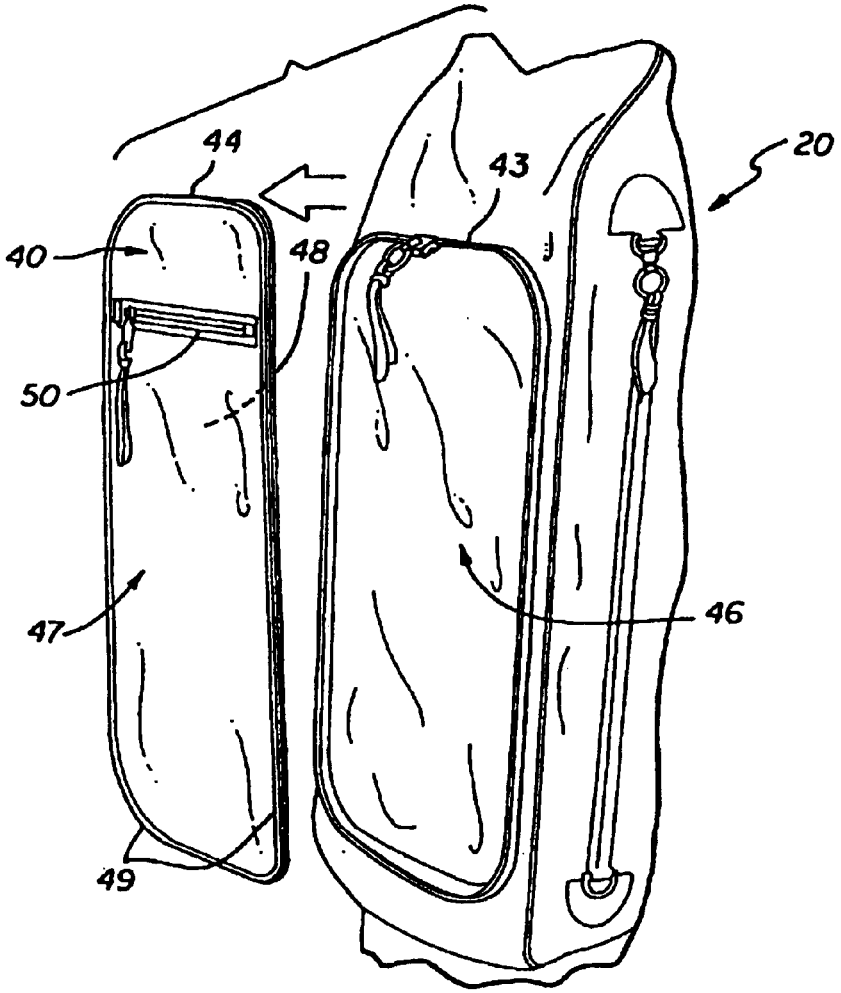

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-13 are cancelled.

* * * * *